US012194523B2

(12) United States Patent
Tanaka

(10) Patent No.: US 12,194,523 B2
(45) Date of Patent: Jan. 14, 2025

(54) METHOD FOR MANUFACTURING PRESSED COMPONENT, METAL SHEET FOR PRESS FORMING, AND HIGH-TENSILE STEEL SHEET

(71) Applicant: JFE STEEL CORPORATION, Tokyo (JP)

(72) Inventor: Hiroyuki Tanaka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 241 days.

(21) Appl. No.: 17/909,883

(22) PCT Filed: Feb. 9, 2021

(86) PCT No.: PCT/JP2021/004801
§ 371 (c)(1),
(2) Date: Sep. 7, 2022

(87) PCT Pub. No.: WO2021/181982
PCT Pub. Date: Sep. 16, 2021

(65) Prior Publication Data

US 2023/0120234 A1 Apr. 20, 2023

(30) Foreign Application Priority Data

Mar. 9, 2020 (JP) ..... 2020-039600

(51) Int. Cl.
*B21D 22/20* (2006.01)
*B21D 11/08* (2006.01)
(Continued)

(52) U.S. Cl.
CPC ..... *B21D 22/206* (2013.01); *B21D 22/26* (2013.01)

(58) Field of Classification Search
CPC ..... B21D 22/206; B21D 22/26; B21D 22/20; B21D 11/08; B21D 17/02; B21D 24/005
See application file for complete search history.

(56) References Cited

U.S. PATENT DOCUMENTS 10,179,360 B2 1/2019 Aso et al.
2002/0184936 A1* 12/2002 Gitlin ..... B21D 5/00 72/379.2
(Continued)

FOREIGN PATENT DOCUMENTS

EP 0726102 A1 8/1996
JP H1-317625 A 12/1989
(Continued)

OTHER PUBLICATIONS

Apr. 6, 2021 Search Report issued in International Patent Application No. PCT/JP2021/004801.
(Continued)

*Primary Examiner* — Mohammed S. Alawadi
(74) *Attorney, Agent, or Firm* — Oliff PLC

(57) ABSTRACT

A method for manufacturing a pressed component including forming a metal sheet into a pressed component shape having: a cross section having a top sheet portion and a side wall portion continuous to at least one side in the width direction of the top sheet portion via a first bent portion; and having one or two or more curved portions in which the top sheet portion is curved to project or to be recessed in a side view along the longitudinal direction in the direction intersecting the cross section, the method which includes: a first preliminary forming step having a step of forming, to the metal sheet, first beads extending along the longitudinal direction at a position where the first bent portion is formed;
(Continued)

(VERTICAL WALL WITH OPENING DEGREE OF 5° )

and a first component forming step of forming the metal sheet after the first preliminary forming step into the pressed component shape.

17 Claims, 5 Drawing Sheets

(51) Int. Cl.

| | |
|---|---|
| ***B21D 17/02*** | (2006.01) |
| ***B21D 22/26*** | (2006.01) |
| ***B21D 24/00*** | (2006.01) |

(56) References Cited

U.S. PATENT DOCUMENTS

| | | | | |
|---|---|---|---|---|
| 2007/0123113 | A1* | 5/2007 | Durney ..... | B21D 11/20 439/701 |
| 2016/0354825 | A1 | 12/2016 | Shinmiya et al. | |
| 2017/0266706 | A1 | 9/2017 | Ito et al. | |
| 2020/0078849 | A1 | 3/2020 | Marx et al. | |
| 2020/0101514 | A1 | 4/2020 | Suzuki et al. | |
| 2021/0114076 | A1 | 4/2021 | Miyake et al. | |

FOREIGN PATENT DOCUMENTS

| | | | | |
|---|---|---|---|---|
| JP | 2013-13934 | A | 1/2013 | |
| JP | 5733475 | B2 | 6/2015 | |
| JP | 6191846 | B2 | 9/2017 | |
| JP | 2019-025509 | A | 2/2019 | |
| JP | 6631759 | B1 | 1/2020 | |
| JP | 2020-124726 | A | 8/2020 | |
| WO | WO-2006133704 | A1 * | 12/2006 | ..... H05K 5/04 |
| WO | 2016/136612 | A1 | 9/2016 | |
| WO | 2018/115282 | A1 | 6/2018 | |
| WO | 2018/225832 | A1 | 12/2018 | |

OTHER PUBLICATIONS

Sep. 6, 2022 International Preliminary Report on Patentability issued in International Application No. PCT/JP2021/004801.
Concise Statement of Relevance of May 24, 2022 Office Action issued in Japanese Patent Application No. 2021-558581.
Translation of Jun. 30, 2022 Decision to Grant Patent issued in Japanese Patent Application No. 2021-558581.
Jul. 27, 2023 Extended European Search Report issued in European Patent Appliction No. 21768026.3.

* cited by examiner (VERTICAL WALL WITH OPENING DEGREE OF 5° )

<SCHEMATIC VIEW IN SIDE VIEW>

METHOD FOR MANUFACTURING PRESSED COMPONENT, METAL SHEET FOR PRESS FORMING, AND HIGH-TENSILE STEEL SHEET

TECHNICAL FIELD

The present invention relates to a technology for manufacturing a pressed component including manufacturing a pressed component having a cross section, such as a U-shaped cross section, a hat-shaped cross section, or an L-shaped cross section, having at least a top sheet portion and a side wall portion continuous to at least one side in the width direction of the top sheet portion and having one or two or more curved portions in which the top sheet portion is curved to project or to be recessed in the sheet thickness direction of the top sheet portion in a side view along the longitudinal direction in the direction intersecting the cross section.

BACKGROUND ART

A large number of pressed components including automobiles and home appliances are produced by transforming a flat metal sheet into various shapes. When mass-producing the pressed components, press forming (pressing) including transforming a metal sheet using a press machine and a die has been widely used for the production of the pressed components. In usual, a metal sheet before work is flat, and therefore the transformation of the metal sheet into a complicated three-dimensional shape requires expansion and contraction of the metal sheet according to a three-dimensional shape. However, the more complicated the shape of the pressed component, the more difficult it is to expand and contract the metal sheet according to the three-dimensional shape. In particular, when the metal sheet to be press formed contains a high-tensile steel sheet or an aluminum alloy sheet having a tensile strength of 590 MPa or more, for example, and a member difficult to form having poor ductility or a poor Lankford Value is adopted as the metal sheet, the above-described problems are likely to occur.

In the press forming, when the metal sheet cannot be expanded and contracted according to the three-dimensional shape, forming defects, such as cracks or wrinkles, are generated in the metal sheet. More specifically, when the metal sheet is transformed into a three-dimensional shape, the metal sheet has no choice but to expand in a site where the length of the metal sheet is insufficient and the shortage in length is not compensated from the surroundings. Then, when the metal sheet is stretched beyond the ductility of the metal sheet itself, cracks are generated. On the other hand, when the metal sheet is transformed into a three-dimensional shape, wrinkles tend to be generated in a case where the length of the metal sheet needs to be shortened or in a site where the length of the metal sheet excessively flows from the surroundings.

Examples of a component shape difficult to achieve by press forming include a press formed component having a cross section having a top sheet portion, a vertical wall portion continuous to the top sheet portion, and a flange portion formed continuously to the vertical wall portion and having one or two or more curved shapes in a side view along the longitudinal direction.

When such a complicated component shape is press formed from a flat metal sheet, tensile deformation or compression deformation occurs in the metal sheet during the forming, and therefore the pressed component is prone to cracks or wrinkles.

Herein, when a product having the above-described complicated shape is press formed from a metal sheet, bending using a die containing a punch, a die, and a pad or drawing using a die containing a punch, a die, and a blank holder is performed, for example. In the case of the bending, wrinkles are generated in the flange portion, causing forming defects. In the case of the drawing, wrinkles are generated in the top sheet portion, causing forming defects.

As a countermeasure for the problems, a method for manufacturing a curved component and a device for manufacturing a curved component described in PTL 1 are mentioned, for example.

CITATION LIST

Patent Literature

PTL 1: JP 5733475 B

SUMMARY OF INVENTION

Technical Problem

Herein, in the case of the bending, the top sheet portion is restrained by the pad, and therefore the tensile deformation or compression deformation in the top sheet portion can be suppressed. However, the flange portion is not restrained, and therefore the metal sheet tends to have wrinkles under the influence of the tensile deformation or the compression deformation. In the case of the drawing, the flange portion is restrained by the blank holder, and therefore the tensile deformation or the compression deformation in the flange portion can be suppressed. However, the top sheet portion is not restrained, and therefore the metal sheet tends to have wrinkles under the influence of the tensile deformation or the compression deformation. Therefore, the generation of wrinkles cannot be suppressed unless the tensile/compression deformation of the metal sheet occurring in the entire component shape are taken into consideration.

With respect to a stamping method, neither the top sheet portion nor the flange portion is restrained, and therefore both the top sheet portion and the flange portion tend to have large wrinkles. Therefore, forming by the stamping method is not mainly used, and pressed components having complicated shapes are formed by a bending method, a drawing method, or a composite process thereof.

Herein, in the method described in PTL 1, the top sheet portion is restrained by the pad and the flange portion is also restrained by the blank holder, so that the tensile/compression deformation in both the top sheet portion and the flange portion can be suppressed. However, it is necessary to restrain a material with the pad in addition to a normal drawing step, and thus the productivity is poor. Further, the method described in PTL 1 has a high die cost.

The present invention has been made focusing on the above-described points. It is an object of the present invention to suppress the generation of wrinkles by a simple means in press forming into a pressed component shape having one or two or more curved portions in which the top sheet portion is curved to project or to be recessed in a side view.

Solution to Problem

The present inventors have studied a press method capable of forming a press formed component without generating cracks or wrinkles and not requiring a complicated die configuration, the press formed component having a hat-shaped cross section including a top sheet portion, vertical wall portions formed on both sides of the top sheet portion, and a flange portion formed continuously to the vertical wall portions and having curved shapes in the upper and lower sides in a side view. Then, the present inventors have obtained the following findings.

(1) Wrinkles in the flange portion can be suppressed by increasing the shape rigidity of a die shoulder edge line portion in preliminary forming, and then performing forming into a product shape by the bending method in the following step.

(2) Further, wrinkles in the top sheet portion can also be suppressed in addition to the wrinkles in the flange portion by increasing the shape rigidity of a punch shoulder edge line portion in addition to the die shoulder edge line portion, and then performing forming into a product shape by the bending method in the following step.

The present invention has been made based on the above-described findings.

More specifically, to solve the above-described problems, one aspect of the present invention is a method for manufacturing a pressed component including forming a metal sheet into a pressed component shape having: a cross section having a top sheet portion and a side wall portion continuous to at least one side in the width direction of the top sheet portion via a first bent portion; and having one or two or more curved portions in which the top sheet portion is curved to project or to be recessed in a side view along the longitudinal direction in the direction intersecting the cross section, the method which includes: a first preliminary forming step having a step of forming, to the metal sheet, a first bead continuously or partially extending along the longitudinal direction at a position where the first bent portion is formed; and a first component forming step of forming the metal sheet after the first preliminary forming step into the pressed component shape.

One aspect of the present invention is a method for manufacturing a pressed component including forming a metal sheet into a pressed component shape having: a cross section having a top sheet portion, a side wall portion continuous to at least one side in the width direction of the top sheet portion via a first bent portion, and a flange portion continuous to the side wall portion via a second bent portion; and having one or two or more curved portions in which the top sheet portion is curved to project or to be recessed in a side view along the longitudinal direction in the direction intersecting the cross section, the method which includes: a second preliminary forming step having a step of forming, to the metal sheet, a second bead continuously or partially extending along the longitudinal direction at a position where the second bent portion is formed; and a second component forming step of forming the metal sheet after the second preliminary forming step into the pressed component shape.

One aspect of the present invention is a metal sheet to be press formed into a pressed component shape having: a cross section having a top sheet portion and a side wall portion continuous to at least one side in the width direction of the top sheet portion via a first bent portion; and having one or two or more curved portions in which the top sheet portion is curved to project or to be recessed in a side view along the longitudinal direction in the direction intersecting the cross section, and the metal sheet has a first bead continuously or partially extending along the longitudinal direction at a position where the first bent portion is formed. One aspect of the present invention is a metal sheet to be press formed into a pressed component shape having: a cross section having a top sheet portion, a side wall portion continuous to at least one side in the width direction of the top sheet portion via a first bent portion, and a flange portion continuous to the side wall portion via a second bent portion; and having one or two or more curved portions in which the top sheet portion is curved to project or to be recessed in a side view along the longitudinal direction in the direction intersecting the cross section, and the metal sheet has a second bead continuously or partially extending along the longitudinal direction at a position where the second bent portion is formed.

Advantageous Effects of Invention

According to the aspects of the present invention, before press forming the metal sheet into the pressed component shape having a curved shape of being vertically curved in a side view, the bead is formed continuously or partially along at least either an edge line portion containing a bent portion connecting the top sheet portion and the side wall portion or an edge line portion containing a bent portion connecting the side wall portion and the flange portion at a position where the edge line portion is formed. As a result, according to the aspects of the present invention, the shape rigidity along the longitudinal direction in the forming into the pressed component shape is improved, and the generation of wrinkles can be effectively suppressed even when the press forming is not necessarily performed while restraining the top sheet portion or the flange portion with the die.

BRIEF DESCRIPTION OF DRAWINGS

FIGS. 1A, 1B, and 1C are views illustrating a pressed component shape according to an embodiment based on the present invention, in which FIG. 1A is a perspective view, FIG. 1B is a side view, and FIG. 1C is an A-A cross-sectional view;

DESCRIPTION OF EMBODIMENTS

Next, embodiments of the present invention will now be described with reference to the drawings.

(Pressed Component Shape)

The pressed component shape after press forming targeted by this embodiment has a cross-sectional shape, such as a U-shaped cross section, a hat-shaped cross section, or an L-shaped cross section, having at least a top sheet portion and a side wall portion continuous to at least one of both sides in the left and right width direction via a first bent portion. Further, the pressed component shape is a shape having one or two or more curved portions in which the top sheet portion is curved to project or to be recessed in a side view along the longitudinal direction in one place or two or more places in the longitudinal direction in the direction intersecting the cross section (sheet width direction). In the case of the hat-shaped cross section, the pressed component shape is a shape in which a flange portion also follows the curve of the top sheet portion in a side view along the longitudinal direction.

Herein, this embodiment relates to a technology suitable for manufacturing a pressed component using a metal sheet containing a difficult-to-form member having poor ductility and a poor Lankford Value, such as a high-tensile steel sheet and an aluminum alloy sheet having a tensile strength of 590 MPa or more.

The description that the top sheet portion is curved to project or to be recessed in a side view refers to a case where the top sheet portion is curved to project or to be recessed in the sheet thickness direction of the top sheet portion along the longitudinal direction.

Figure 1A:
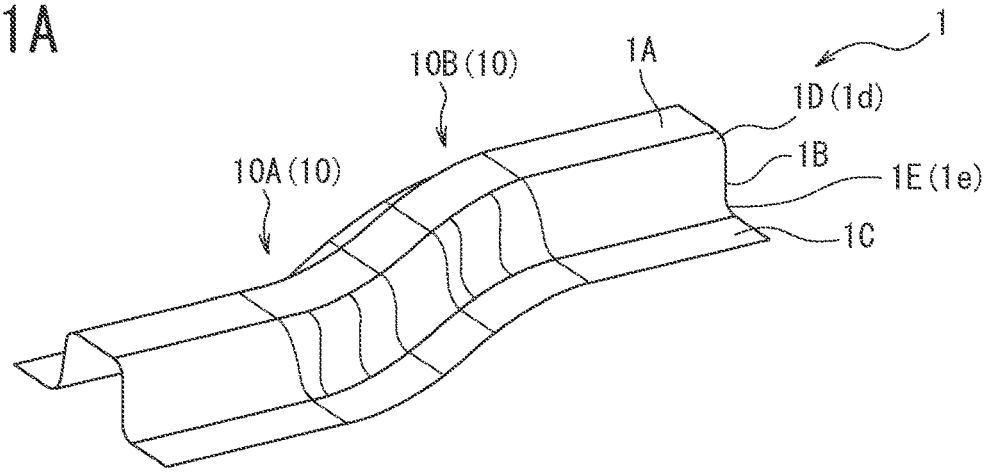
Figure 1B:
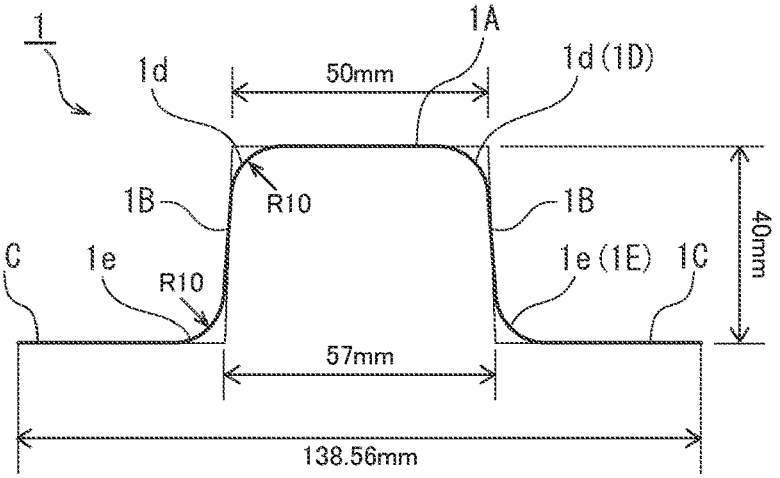
Figure 1C:
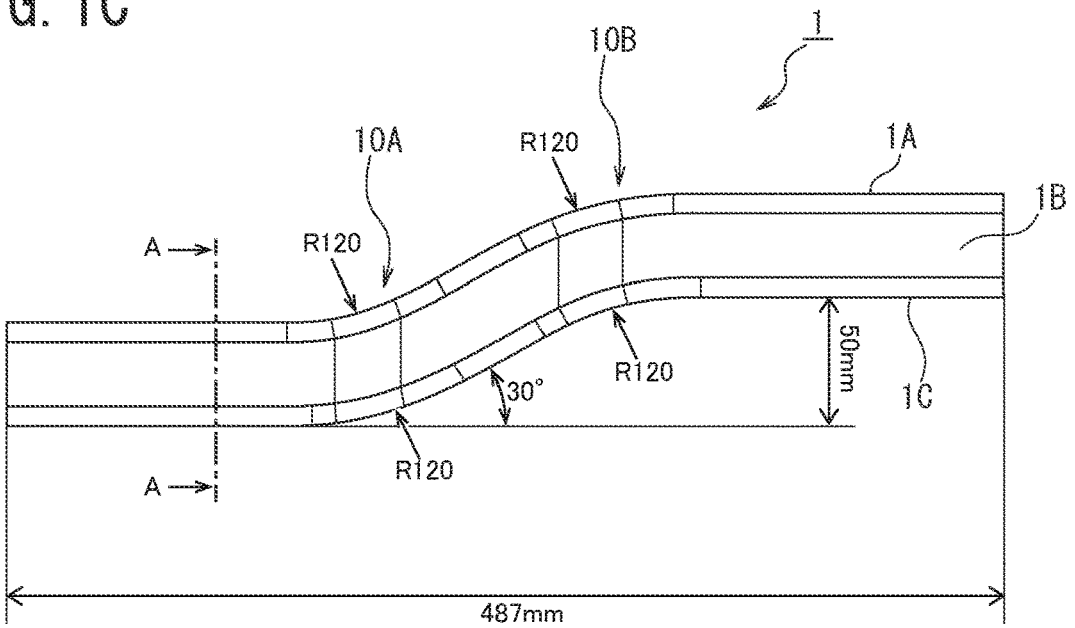

This embodiment describes a target pressed component shape 1 after press forming taking, as an example, a case of performing forming into the pressed component shape 1 having a hat-shaped cross section and having curved portions 10 in two places along the longitudinal direction as illustrated in FIG. 1. More specifically, this embodiment exemplifies, as the target pressed component shape 1, a case of a hat-shaped cross section and having a curved portion 10A where a top sheet portion 1A is curved to be recessed (bent downward) and a curved portion 10B where the top sheet portion 1A is curved to project (bent upward) in two places along the longitudinal direction as illustrated in FIG. 1. However, in this embodiment, the curved portion 10 may be formed in one place or the curved portions 10 may be formed in three or more places. Even when the curved portions 10 are formed in two or more places, a shape may be acceptable in which the curved portions 10 in the two places adjacent to each other are curved in the same direction.

It should be noted that the dimensions illustrated in FIG. 1 are the dimensions in Examples and do not limit the present invention at all.

(Configuration)

Figure 2:
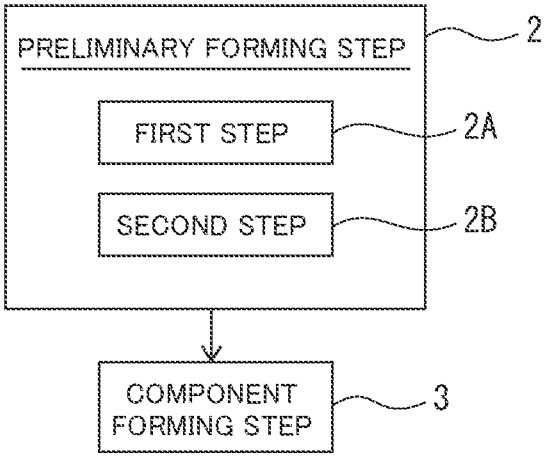
FIG. 2 is a view illustrating a step example of a method for manufacturing a pressed component according to the embodiment based on the present invention.

A method for manufacturing a pressed component of this embodiment includes a preliminary forming step 2 and a component forming step 3 as illustrated in FIG. 2.

<Preliminary Forming Step 2>

The preliminary forming step 2 is a step of obtaining a metal sheet for main forming difficult to cause wrinkles by applying preliminary forming before main forming to the metal sheet.

The preliminary forming step 2 has a first step 2A of giving, to a flat metal sheet, a curved shape following the curves of the curved portions 10 provided in the pressed component shape 1 along the longitudinal direction of the pressed component shape 1 and a second step 2B of forming first beads 4*a* and second beads 4*b* at positions where a first bent portion 1*d* and a second bent portion 1*e* are formed, respectively. The first beads 4*a* and the second beads 4*b* each continuously or partially extend along the longitudinal direction.

The second step 2B may be a step of forming only either the first beads 4*a* or the second beads 4*b*. Further, the first beads 4*a* and the second beads 4*b* may be arranged such that the formation positions of the first beads 4*a* and the formation positions of the second beads 4*b* do not overlap with each other in the longitudinal direction.

The preliminary forming step 2 may include only the second step 2B.

In this specification, the "beads continuously or partially extending along the longitudinal direction" includes a case where the beads are continuously formed over the entire length in the longitudinal direction of the metal sheet 4 and a case where the beads are formed in a part along the longitudinal direction of the metal sheet 4. A plurality of beads may be formed at intervals along the longitudinal direction of the metal sheet 4. For example, when the pressed component shape 1 has two or more of the curved portions 10, the beads may be continuously formed in two or more places where the curved portions 10 are formed or the beads may be individually formed for each of the curved portions 10.

Figure 6:
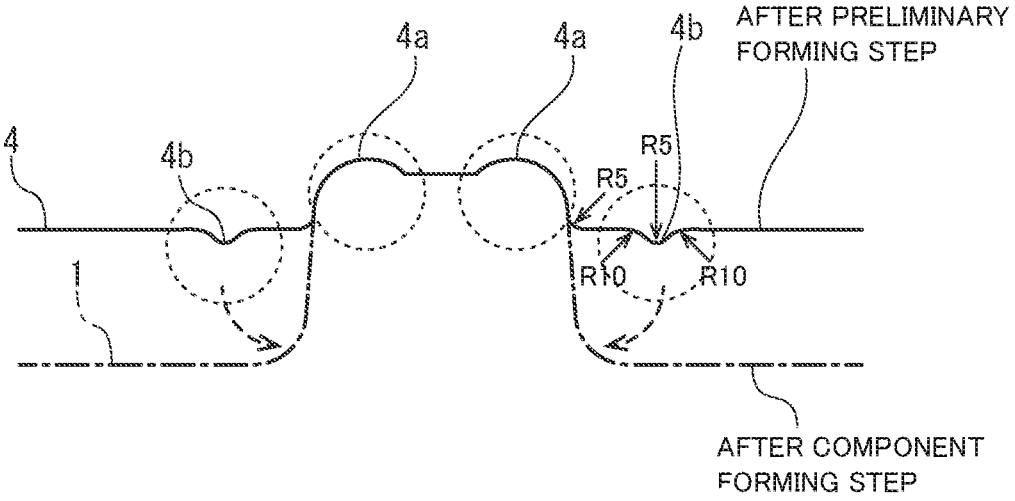
FIG. 6 is a schematic view viewed from the front illustrating an example of beads after a preliminary forming step.

FIG. 6 illustrates an example of the cross-sectional shapes of the first beads 4*a* and the second beads 4*b*. The example illustrated in FIG. 6 is an example in which the first beads 4*a* and the second beads 4*b* are constituted by a full bead.

Herein, the beads 4*a*, 4*b* of this embodiment have a shape in which the cross section of a bent shape extends in a direction intersecting the cross section (longitudinal direction (longitudinal direction of the top sheet portion of the metal sheet 4)). The beads 4*a*, 4*b* contain a full bead or a half bead having a stepped cross-sectional shape.

For the curved shape following the curves of the curved portions 10 provided in the pressed component shape 1, a profile shape in a side view of the top sheet portion 1A of the pressed component shape 1 (for example, profile shape along the longitudinal direction of an edge line portion formed by the first bent portion 1*d*) is adopted. The curvature radius of the curved portions 10 of the curved shape given to the metal sheet 4 in a side view is preferably set to be equal to the curvature radius of the curved portions 10 provided in the pressed component shape 1. A difference between the curvature radius of the curved portions 10 of the curved shape given to the metal sheet 4 and the curvature radius of the curved portions 10 provided in the pressed component shape 1 is preferably set to be ±10% or less of the curvature radius of the curved portions 10 provided in the pressed component shape 1, for example.

The first bent portion 1*d* corresponds to the cross section of an edge line portion 1D formed between the top sheet portion 1A and a vertical wall portion. The edge line portion 1D is bent to project upward. The second bent portion 1*e* corresponds to the cross section of an edge line portion 1E formed between the vertical wall portion and a flange portion 1C. The edge line portion 1E is bent to be recessed upward.

Herein, the second step 2B may have a processing configuration of forming only either the first beads 4*a* or the second beads 4*b*.

In this embodiment, the first step 2A and the second step 2B are carried out by pressing using one die.

Figure 3:
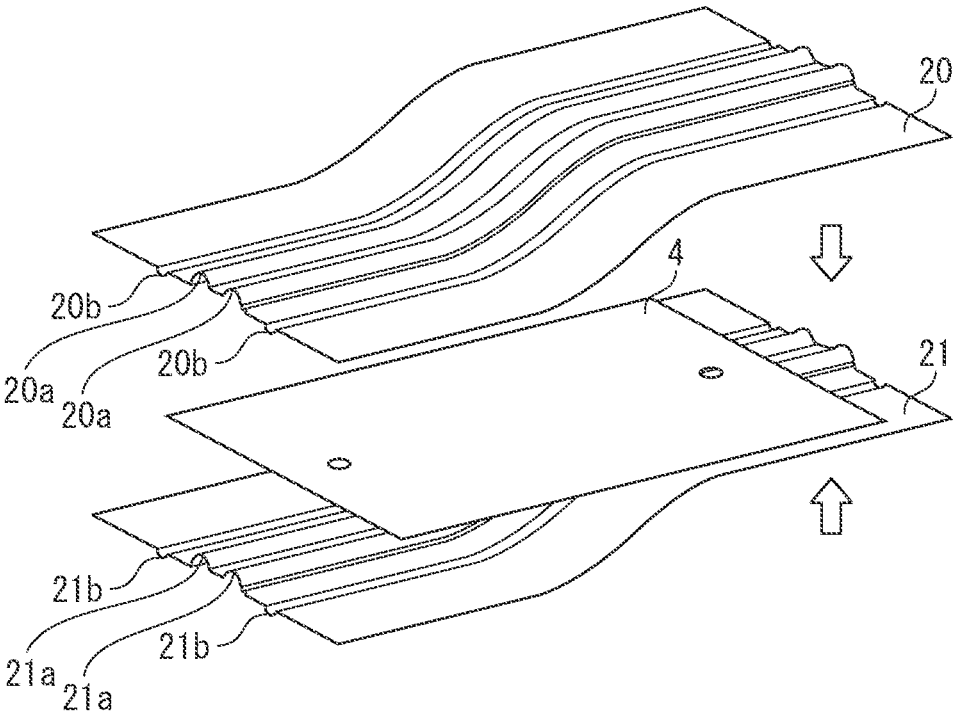
FIG. 3 is a view for explaining forming surfaces of a die in a preliminary forming step.

As illustrated in FIG. 3, the die to be used has forming surfaces 20, 21 of an upper die (die) and a lower die (punch), respectively, given with the same curves as the curved shape of the pressed component shape 1 in a side view. The pressed component shape 1 of this embodiment has a shape of having the curved portion 10A in which the top sheet portion 1A is bent to be recessed (bent downward) and the curved portion 10B in which the top sheet portion 1A is bent to project (bent upward). The forming surfaces 20, 21 of the upper die (die) and the lower die (punch), respectively, have a surface shape having a portion in which the top sheet portion 1A is bent to be recessed (bent downward) and a portion in which the top sheet portion 1A is bent to project (bent upward) according to the shape following the shape in a side view.

Thus, the metal sheet 4 is given with the same curved shape in the width direction (same direction as the width direction of the pressed component shape 1), for example.

The curved shape in a side view of the forming surfaces 20, 21 of the upper die (die) and the lower die (punch), respectively, is preferably equal to the curved shape in the top sheet portion 1A in a side view in the pressed component shape 1.

In usual, the curved shape of the top sheet portion 1A and the curved shape of the flange portion 1C in a side view along the longitudinal direction are equal or substantially equal to each other. Therefore, the curved shape in a side view of the forming surfaces of the upper die (die) and the lower die (punch) may have a shape following the curved shape of the top sheet portion 1A along the longitudinal direction. When the curved shape of the top sheet portion 1A and the curved shape of the flange portion 1C in a side view are different from each other, the curved shapes at the surface position where the top sheet portion 1A is formed and the surface position where the flange portion 1C is formed may have different shapes. In this case, the difference in the curved shape may be absorbed by the forming surfaces forming the vertical wall portion.

Further, the forming surfaces 20, 21 of the upper die (die) and the lower die (punch) have bead shapes 20*a*, 21*a* following the first beads 4*a* and the bead shapes 20*b*, 21*b* following the second beads 4*b*, respectively, extending along the positions where the first bent portion 1*d* and the second bent portion 1*e* are formed, i.e., along the longitudinal direction. The positions where the first bead shapes 20*a*, 21*a* and the second bead shapes 20*b*, 21*b* are formed are positions contactable with a punch shoulder edge line portion and a die shoulder edge line portion of a die in the component forming step 3 in the component forming step 3.

Herein, the first beads 4*a* preferably have a shape of projecting in the same direction as the projection direction of the first bent portion 1*d* (a shape of projecting upward in the cross section) (see FIG. 6).

The bead height of the first beads 4*a* is preferably twice or more the sheet thickness of the metal sheet 4. The upper limit of the bead height of the first beads 4*a* is 20 mm.

The second beads 4*b* preferably have a shape of projecting in the same direction as the projection direction of the second bent portion 1*e* (a shape bent downward) (see FIG. 6).

The bead height of the second beads 4*b* is preferably twice or more the sheet thickness of the metal sheet 4. The upper limit of the bead height of the second beads 4*b* is 20 mm.

In the preliminary forming step 2, the metal sheet 4 is press formed using the upper and the lower die above, so that the metal sheet 4 is obtained which includes the first beads 4*a* and the second beads 4*b* curved along the longitudinal direction and extending along the longitudinal direction.

<Component Forming Step 3>

The component forming step 3 is a main forming step of forming the metal sheet 4 processed in the preliminary forming step into the target pressed component shape 1.

Figure 4:
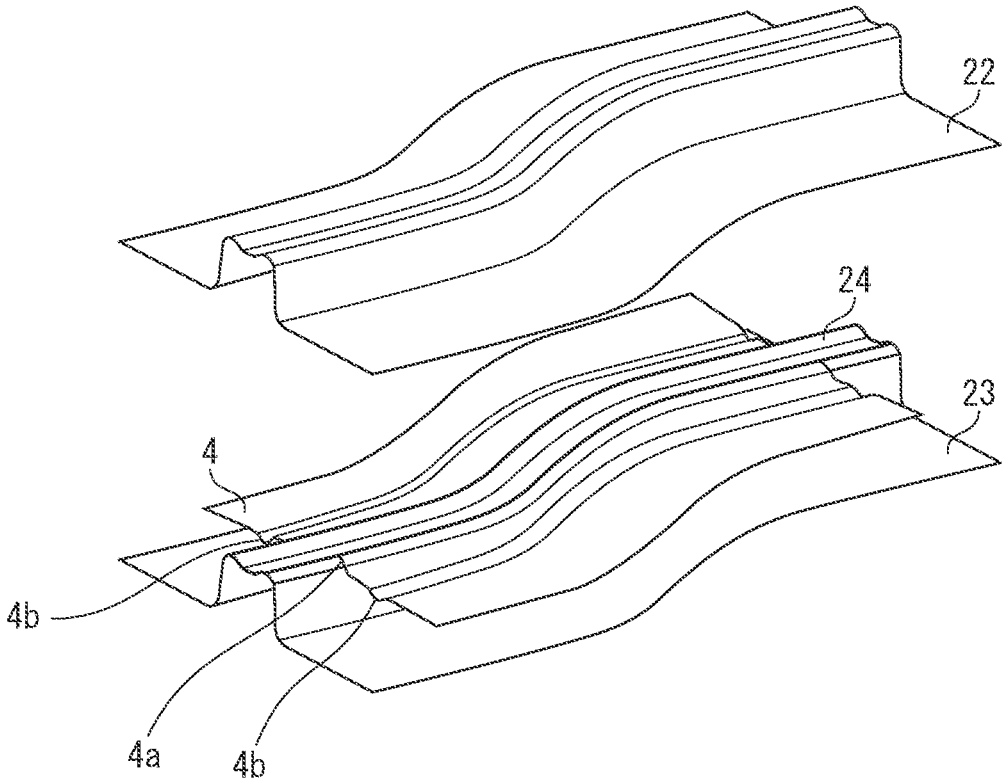
FIG. 4 is a view for explaining forming surfaces of a die in a component forming step.

The component forming step 3 includes press forming the metal sheet 4 after the processing in the preliminary forming step 2 using a die having forming surfaces 22, 23 as illustrated in FIG. 4 to obtain a pressed component of the target pressed component shape 1.

FIG. 4 exemplifies a case where the die has a pad 24 holding the position where the top sheet portion 1A is formed of the metal sheet 4. More specifically, this example exemplifies a case where bending forming is adopted as the press forming. However, the component forming step 3 may adopt stamping in which the top sheet portion 1A is not held by the pad 24.

Herein, the preliminary forming step 2 constitutes at least either the first preliminary forming step or the second preliminary forming step. The component forming step 3 constitutes at least either the first component forming step or the second component forming step.

(Operations and Others)

In this embodiment, the preliminary forming step 2 carries out processing of giving the curved shape (shape of being curved in the sheet thickness direction) along the longitudinal direction to the metal sheet 4 and processing of giving at least either the first beads 4*a* or the second beads 4*b* to the metal sheet 4 (FIG. 3) as preliminary forming.

At this time, when the metal sheet 4 is pressed with the upper die and the lower die for the preliminary forming step 2, the metal sheet 4 is first transformed into the curved shape along the forming surfaces 20, 21 of the upper die and the lower die, respectively, as the upper die relatively approaches the lower die. Further, the upper die relatively approaches the lower die and moves to the bottom dead center, so that the first beads 4*a* and the second beads 4*b* are press formed in the metal sheet 4 in the state of the curved sheet shape. More specifically, the formation of the beads 4*a*, 4*b* is carried out after the curved shape is given to the metal sheet 4.

By the formation of the first beads 4*a* and the second beads 4*b* extending in the longitudinal direction after the curved shape is given, springback along the longitudinal direction during die release of the curved shape given as the first step 2A is kept small.

The metal sheet 4 in the preliminary forming step 2 becomes higher in shape rigidity in the longitudinal direction by giving the beads 4*a*, 4*b*.

Next, when the metal sheet 4 after the preliminary forming step 2 is pressed in the component forming step 3 to have a U-shaped cross section or a hat-shaped cross section having the curved portions 10 vertically curved in a side view, the metal sheet 4 has a higher shape rigidity in the longitudinal direction due to the beads 4*a*, 4*b*, and therefore the generation of wrinkles due to buckling is suppressed.

Figure 5:
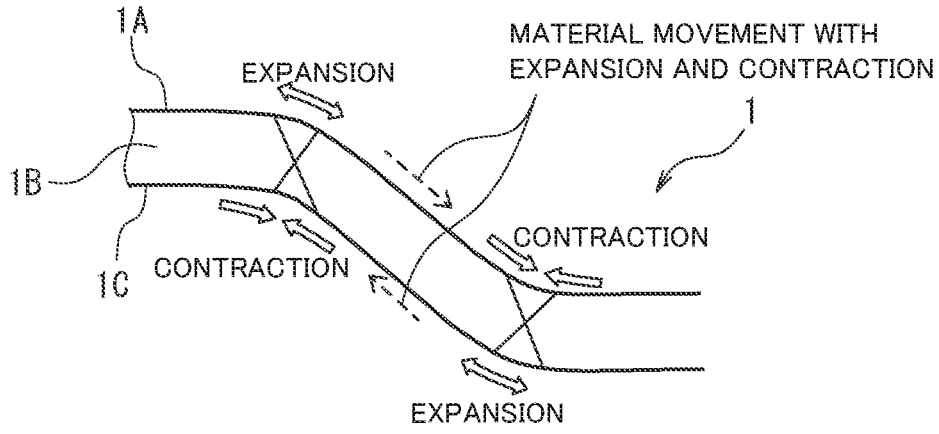
FIG. 5 is a schematic view viewed from the side for explaining a cause of the generation of wrinkles in a prior art.

Herein, when the metal sheet 4 containing a flat sheet is press formed into the component shape having the curved portions 10 vertically curved in a side view, the expansion in the longitudinal direction occurs on the top sheet portion 1A side (projection side) and the contraction in the longitudinal direction occurs on the flange portion 1C side (recess side) in the curved portion 10 projecting toward the top sheet portion 1A side as illustrated in FIG. 5. In the curved portion 10 recessed toward the top sheet portion 1A side, the contraction in the longitudinal direction occurs on the top sheet portion 1A side (recess side) and the expansion in the longitudinal direction occurs on the flange portion 1C side (projection side).

Then, a material movement occurs in the longitudinal direction on the top sheet portion 1A side and the flange portion 1C side with the expansion and contraction, causing the generation of wrinkles. For example, when the bending forming in which the top sheet portion 1A is restrained is adopted, there is a risk of the generation of wrinkles due to buckling in the curved portion 10 projecting toward the top sheet portion 1A in the flange portion 1C where the material freely moves. When the drawing is adopted, the flange portion 1C is restrained, and therefore there is a risk of the generation of wrinkles due to buckling in the curved portion 10 recessed toward the top sheet portion 1A in the top sheet portion 1A where the material freely moves. When the stamping is adopted, the material freely moves in both the top sheet portion 1A and the flange portion 1C, and therefore there is a risk of the generation of wrinkles in the top sheet portion 1A and the flange portion 1C.

In contrast thereto, in the component forming step 3 of this embodiment, the first beads 4*a* and the second beads 4*b* as illustrated in FIG. 6 are formed in advance in the metal sheet 4, so that the shape rigidity in the longitudinal direction of the metal sheet 4 increases. As a result, in the press forming in the component forming step 3, the generation of wrinkles due to buckling to the metal sheet 4 is suppressed and the deformation of the edge line portion 1D between the top sheet portion 1A and the side wall portion 1B and the edge line portion 1E between the side wall portion 1B and the flange portion 1C is prevented.

Figure 7:
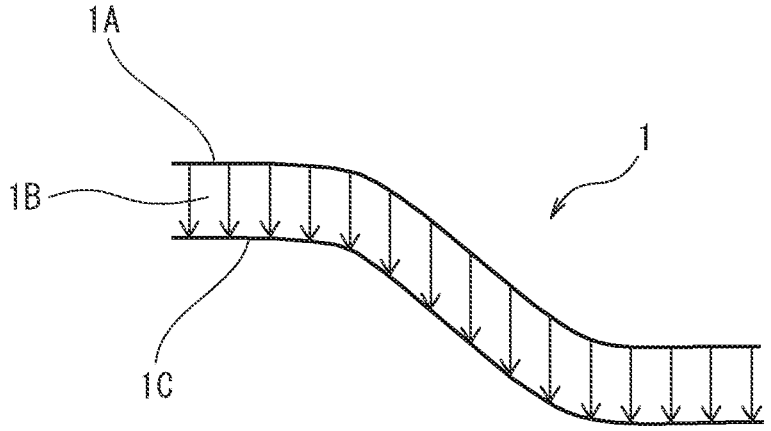
FIG. 7 is a schematic view viewed from the side for explaining the suppression of wrinkles in the embodiment based on the present invention.

Therefore, in this embodiment, the flange surface is formed by the movement in parallel to the press direction with respect to the top sheet portion 1A as illustrated in FIG. 7, and the material movement causing wrinkles is suppressed in the press forming in the component forming step 3.

Further, by giving the curved shape along the longitudinal direction to the metal sheet 4 in advance, the flange surface is formed by the movement in parallel to the press direction with respect to the top sheet portion 1A, and the material movement causing wrinkles is further suppressed in the press forming.

(Modification)

(1) The description above exemplifies the case where the first step 2A and the second step 2B of the preliminary forming step 2 are carried out with one die.

The first step 2A and the second step 2B may be carried out using individual dies for the steps. However, in this case, it is preferable that the curved shape is given to the metal sheet 4 in the first step 2A, and then the beads 4*a*, 4*b* are given in the second step 2B.

(2) The description above exemplifies the case where both the steps of the first step 2A and the second step 2B are carried out in the preliminary forming step 2. It may acceptable that the first step 2A is omitted and only the second step 2B (step of forming the beads) is carried out in the preliminary forming step 2. It may be acceptable that the curved shape of being curved in the vertical direction in a side view and the bending at the first bent portion 1*d* and the second bent portion 1*e* positions along the width direction are carried out in the component forming step 3.

(3) The description above exemplifies the case where the first beads 4*a* and the second beads 4*b* are formed in the entire positions where the edge line portions 1D, 1E containing the first bent portion 1*d* and the second bent portion 1*e*, respectively, are formed, but the first beads 4*a* and the second beads 4*b* may be partially provided at the corresponding positions of the edge line portions 1D, 1E, respectively, along the longitudinal direction.

In this case, it is preferable that the beads are formed in at least a first estimation region where it is estimated that wrinkles are generated in the top sheet portion 1A when the metal sheet 4 containing a flat sheet is press formed into the pressed component shape 1 and a second estimation region where it is estimated that wrinkles are generated in the flange portion 1C when the metal sheet 4 containing a flat sheet is press formed into the pressed component shape 1.

Figure 8:
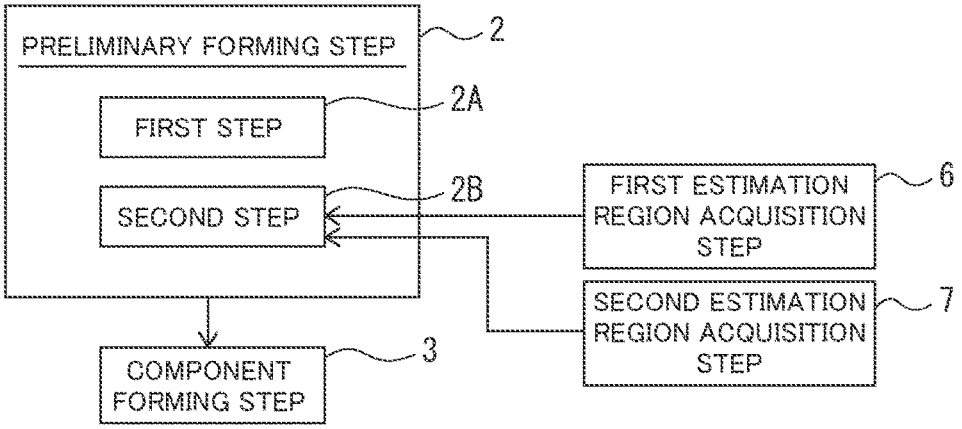
FIG. 8 is a view for explaining a processing step in a modification according to the embodiment based on the present invention.

At this time, it is preferable to include a first estimation region acquisition unit 6 and a second estimation region acquisition unit 7 as illustrated in FIG. 8.

The first estimation region acquisition unit 6 carries out processing of obtaining the first estimation region where it is estimated that wrinkles are generated in the top sheet portion 1A when the metal sheet 4 containing a flat sheet is press formed into the pressed component shape 1.

The second estimation region acquisition unit 7 carries out processing of obtaining the second estimation region where it is estimated that wrinkles are generated in the flange portion 1C when the metal sheet 4 containing a flat sheet is press formed into the pressed component shape 1.

The processing by the first estimation region acquisition unit 6 and the second estimation region acquisition unit 7 may be carried out by forming analysis using a computer or may include actually carrying out the press forming.

Further, the wrinkles in the forming are generated in the curved portion 10 on the side where the material gathers of the curved portions 10, and therefore the curved portion 10 where the top sheet portion 1A is curved to be recessed may be simply estimated as the first estimation region and the curved portion 10 where the top sheet portion 1A is curved to project may be simply estimated as the second estimation region.

(Effects)

This embodiment exhibits the following effects.

(1) In this embodiment, the method for manufacturing a pressed component includes forming the metal sheet 4 into the pressed component shape 1 having: the cross section having the top sheet portion 1A and the side wall portion 1B continuous to at least one side in the width direction of the top sheet portion 1A via the first bent portion 1*d*; and having the one or two or more curved portions 10 in which the top sheet portion 1A is curved to project or to be recessed in a side view along the longitudinal direction in the direction intersecting the cross section, and the method includes: the first preliminary forming step having the step of forming, to the metal sheet 4, the first beads 4*a* continuously or partially extending along the longitudinal direction at the position where the first bent portion 1*d* is formed; and the first component forming step of forming the metal sheet 4 after the first preliminary forming step into the pressed component shape 1.

This configuration can suppress the generation of wrinkles at least in the top sheet portion 1A by forming the first beads 4*a* along the position where the edge line portion containing a bent portion connecting the top sheet portion 1A and the side wall portion 1B is formed before performing the press forming into the pressed component shape 1 having the curved shapes in the upper and lower sides in a side view, so that the shape rigidity along the longitudinal direction in the forming into the pressed component shape 1 is improved.

(2) The pressed component shape has the cross section having the flange portion continuous to the side wall portion via the second bent portion, and the first preliminary forming step has the step of forming the first beads and the step of forming, to the metal sheet, the second beads continuously or partially extending along the longitudinal direction at the position where the second bent portion is formed.

According to this configuration, the shape rigidity along the longitudinal direction of not only the edge line portion on the top sheet portion 1A side but the edge line portion on the flange side is improved, so that the generation of wrinkles not only in the top sheet portion 1A but in the flange portion 1C can be suppressed.

(3) The first beads and the second beads each partially extend at least at the positions where the curved portions are formed. The position where the curved portion is formed, the position being the formation position of the first beads and the position where the curved portion is formed, the position being the formation position of the second beads, are different from each other.

According to this configuration, the bead formation positions can be suppressed.

(4) The first beads 4*a* preferably have a shape of projecting in the same direction as the projection direction of the first bent portion 1*d*.

According to this configuration, the bead shape of the first beads 4*a* can be easily crushed in the component forming step 3. The target pressed component shape 1 may be a shape in which the beads are formed along an edge line portion connecting the top sheet portion 1A and the side wall portion 1B.

The top sheet portion 1A is a surface serving as a connection portion with another component, and therefore it is preferable that no beads are formed.

(5) The first preliminary forming step may have the step of giving the curves following the curves of the curved portions 10 along the longitudinal direction to the metal sheet 4 and the step of forming the first beads 4*a*.

According to this configuration, the first preliminary forming step gives the curved shape together with the first beads 4*a*, so that the shape accuracy in the longitudinal direction is improved, for example.

(6) This embodiment may be configured so that the first estimation region acquisition unit 6 is included which obtains the first estimation region where it is estimated that wrinkles are generated in the top sheet portion 1A when the metal sheet 4 containing a flat sheet is press formed into the pressed component shape 1, and the first preliminary forming step partially forms the first beads 4*a* to the metal sheet 4 portion corresponding to the bent portion containing a region serving as the first estimation region of the edge line portion formed by the bent portion.

This configuration prevents the giving of the first beads 4*a* more than necessary.

(7) The bead height of the first beads 4*a* is preferably twice or more the sheet thickness of the metal sheet 4.

This configuration can certainly improve the shape rigidity in the longitudinal direction.

(8) This embodiment may be configured so that the second estimation region acquisition unit 7 is included which obtains the second estimation region where it is estimated that wrinkles are generated in the flange portion 1C when the metal sheet 4 containing a flat sheet is press formed into the pressed component shape 1, and the first preliminary forming step partially forms the second beads 4*b* to the metal sheet 4 portion corresponding to the second bent portion 1*e* containing a region serving as the second estimation region of the edge line portion formed by the second bent portion 1*e*.

This configuration prevents the giving of the second beads 4*b* more than necessary.

(9) This embodiment may be configured so that the method for manufacturing a pressed component includes forming the metal sheet 4 into the pressed component shape 1 having: the cross section having the top sheet portion 1A, the side wall portion 1B continuous to at least one side in the width direction of the top sheet portion 1A via the first bent portion 1*d*, and the flange portion 1C continuous to the side wall portion 1B via the second bent portion 1*e*; and having the one or two or more curved portions 10 in which the top sheet portion 1A is curved to project or to be recessed in a side view along the longitudinal direction in the direction intersecting the cross section, and the method includes: the second preliminary forming step of forming, to the metal sheet 4, the second beads 4*b* continuously or partially extending along the longitudinal direction at the position where the second bent portion 1*e* is formed; and the second component forming step of forming the metal sheet 4 after the second preliminary forming step into the pressed component shape 1.

This configuration can suppress the generation of wrinkles at least in the flange portion 1C by forming the second beads 4*b* at the position where the edge line portion containing the bent portion connecting the side wall portion 1B and the top sheet portion 1A is formed before performing the press forming into the pressed component shape 1 having the curved shapes in the upper and lower sides in a side view, so that the shape rigidity along the longitudinal direction in the forming into the pressed component shape 1 is improved.

(10) The second preliminary forming step may have the step of giving the curves following the curves of the curved portions 10 along the longitudinal direction to the metal sheet 4 and the step of forming the second beads 4*b*.

According to this configuration, the second preliminary forming step gives the curved shape together with the second beads 4*b*, and the shape accuracy in the longitudinal direction is improved, for example.

(11) This embodiment may be configured so that the second estimation region acquisition unit 7 is included which obtains the second estimation region where it is estimated that wrinkles are generated in the flange portion 1C when the metal sheet 4 containing a flat sheet is press formed into the pressed component shape 1, and the second preliminary forming step partially forms the second beads 4*b* to the metal sheet 4 portion corresponding to the second bent portion 1*e* containing a region serving as the second estimation region of the edge line portion formed by the second bent portion 1*e*.

This configuration prevents the giving of the second beads 4*b* more than necessary.

(12) The second beads 4*b* preferably have a shape of being recessed in the same direction as the recessing direction of the second bent portion 1*e*.

According to this configuration, the bead shape of the second beads 4*b* can be easily crushed in the component forming step 3. The target pressed component shape 1 may be a shape in which the beads are formed along an edge line portion connecting the side wall portion 1B and the flange portion 1C.

(13) The bead height of the second beads 4*b* is preferably twice or more the sheet thickness of the metal sheet 4.

This configuration can certainly improve the shape rigidity in the longitudinal direction.

(14) This embodiment may be configured so that the metal sheet 4 is to be press formed into the pressed component shape 1 having: the cross section having the top sheet portion 1A and the side wall portion 1B continuous to at least one side in the width direction of the top sheet portion 1A via the first bent portion 1*d*; and having the one or two or more curved portions 10 in which the top sheet portion 1A is curved to project or to be recessed in a side view along the longitudinal direction in the direction intersecting the cross section, and the metal sheet 4 has the first beads 4*a* continuously or partially extending along the longitudinal direction at the position where the first bent portion 1*d* is formed.

This configuration can suppress wrinkles generated at least in the top sheet portion 1A in the press forming into the pressed component shape 1 having: the cross section having the top sheet portion 1A and the side wall portion 1B continuous to at least one side in the width direction of the top sheet portion 1A via the first bent portion 1*d*; and having the one or two or more curved portions 10 in which the top sheet portion 1A is curved to project or to be recessed in a side view along the longitudinal direction in the direction intersecting the cross section.

(15) Further, the metal sheet 4 may be configured to be press formed into the pressed component shape 1 having the cross section having the flange portion 1C continuous to the side wall portion 1B via the second bent portion 1*e* and to have the second beads 4*b* extending along the longitudinal direction at the position where the second bent portion 1*e* is formed together with the first beads 4*a*.

This configuration can suppress wrinkles generated in the top sheet portion 1A and the flange portion 1C in the press forming into the pressed component shape 1 having: the cross section having the top sheet portion 1A and the side wall portion 1B continuous to at least one side in the width direction of the top sheet portion 1A via the first bent portion 1*d*; and having the one or two or more curved portions 10 in which the top sheet portion 1A is curved to project or to be recessed in a side view along the longitudinal direction in the direction intersecting the cross section.

(16) Further, the metal sheet 4 may be configured to have the curves following the curves of the curved portions 10 along the longitudinal direction.

This configuration improves the shape accuracy in the longitudinal direction in the press forming into the pressed component shape 1.

(17) This embodiment may be configured so that the metal sheet 4 is to be press formed into the pressed component shape 1 having: the cross section having the top sheet portion 1A, the side wall portion 1B continuous to at least one side in the width direction of the top sheet portion 1A via the first bent portion 1*d*, and the flange portion 1C continuous to the side wall portion 1B via the second bent portion 1*e*; and having the one or two or more curved portions 10 in which the top sheet portion 1A is curved to project or to be recessed in a side view along the longitudinal direction in the direction intersecting the cross section, and the metal sheet 4 has the second beads 4*b* continuously or partially extending along the longitudinal direction at the position where the second bent portion 1*e* is formed.

This configuration can suppress wrinkles generated at least in the flange portion 1C in the press forming into the pressed component shape 1 having: the cross section having the top sheet portion 1A and the side wall portion 1B continuous to at least one side in the width direction of the top sheet portion 1A via the first bent portion 1*d*; and having the one or two or more curved portions 10 in which the top sheet portion 1A is curved to project or to be recessed in a side view along the longitudinal direction in the direction intersecting the cross section.

(18) Further, the metal sheet 4 may be configured to have the curves following the curves of the curved portions 10 along the longitudinal direction.

This configuration improves the shape accuracy in the longitudinal direction in the press forming into the pressed component shape 1.

EXAMPLES

Next, examples of the press forming of the above-described embodiment based on the present invention are described. The present invention is not regulated by the following examples described below.

[Applied Materials]

In this example, a high-tensile steel sheet of 590 MPa or more was used as the metal sheet 4.

Specifically, as the metal sheet 4, a 590 MPa class steel sheet (590 material), a 980 MPa class steel sheet (980 material), a 1180 MPa class steel sheet (1180 material), and a 1470 MPa class steel sheet (1470 material) were used as shown in Table 1.

TABLE 1

| Steel type | Sheet thickness (mm) | YP (MPa) | TS (MPa) | EL (%) |
|---|---|---|---|---|
| 590 MPa material | 1.6 | 381 | 608 | 29 |
| 980 MPa material | 1.6 | 680 | 1041 | 16 |
| 1180 MPa material | 1.6 | 863 | 1242 | 12 |
| 1470 MPa material | 1.6 | 1246 | 1509 | 8 |

As the metal sheet 4, a flat sheet with a width W of 240 mm, a length L of 387 mm, and a sheet thickness of 1.0 mmt was used.

In this example, the target component shape of a pressed component was set to a shape having a hat-shaped cross section and the curved portions 10 in two places along the longitudinal direction in a side view as illustrated in FIG. 1.

In Comparative Examples, a flat metal sheet was directly press formed into the above-described pressed component shape by forming methods shown in Table 2. In Examples of Invention based on the present invention, a metal sheet was press formed into the above-described pressed component shape by forming methods shown in Table 3. More specifically, in the forming methods of Comparative Examples, the metal sheet containing a flat sheet was press formed into the target pressed component shape 1 in the component forming step 3 (main forming step) without the preliminary forming step 2. In the forming methods in Examples of Invention based on the present invention, the target pressed component shape was achieved in the component forming step 3 after performing the preliminary forming step 2 based on this embodiment. The results are shown in Tables 2 and 3.

Table 2 shows the evaluation results (propriety of forming) of the forming methods of Comparative Examples.

Table 3 shows the evaluation results (propriety of forming) of the forming methods of Examples of Invention.

In the tables, P pressure is a pad pressure and C pressure is a cushion pressure.

TABLE 2

| | | | | Determination of wrinkles | | | | | | | |
|---|---|---|---|---|---|---|---|---|---|---|---|
| | | | | 590 material | | 980 material | | 1180 material | | 1470 material | |
| | | | | Recessed | | | Projection | | | | |
| | Step | P pressure (t) | C pressure (t) | portion of top sheet portion | Projection portion of flange portion | Recessed portion of top sheet portion | portion of flange portion | Recessed portion of top sheet portion | Projection portion of flange portion | Recessed portion of top sheet portion | Projection portion of flange portion |
| Comparative Examples | Form | — | — | x | Δ | x | x | x | x | x | x |
| | Pad form | 20 | — | ○ | Δ | ○ | x | ○ | x | ○ | x |
| | Drawing | — | 50 | Δ | ○ | x | ○ | x | ○ | x | ○ |

TABLE 3

| | | | | | | Determination of wrinkles | | | | | | | | |
|---|---|---|---|---|---|---|---|---|---|---|---|---|---|---|
| | | | | | | 590 material | | 980 material | | 1180 material | | 1470 material | | |
| | | | Step | | | Recessed | Projection | Recessed | Projection | Recessed | Projection | Recessed | Projection | |
| No. | First bead | Second bead | Preliminary forming step | Component forming step | P pressure (t) | portion of top sheet portion | portion of flange portion | portion of top sheet portion | portion of flange portion | portion of top sheet portion | portion of flange portion | portion of top sheet portion | portion of flange portion | Bead shape |
| 1 | 2 | 2 | Form | Form | — | ○ | ○ | ○ | ○ | ○ | ○ | ○ | ○ | 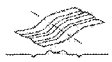 |
| | | | Form | Pad form | 20 | ○ | ○ | ○ | ○ | ○ | ○ | ○ | ○ | |
| 2 | 1 | 2 | Form | Form | — | Δ | ○ | x | ○ | x | ○ | x | ○ | 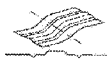 |
| | | | Form | Pad form | 20 | ○ | ○ | ○ | ○ | ○ | ○ | ○ | ○ | |
| 3 | — | 2 | Form | Form | — | x | ○ | x | ○ | x | ○ | x | ○ | 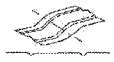 |
| | | | Form | Pad form | 20 | ○ | ○ | ○ | ○ | ○ | ○ | ○ | ○ | |
| 4 | 2 | — | Form | Form | — | ○ | Δ | ○ | x | ○ | x | ○ | x | 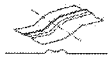 |
| | | | Form | Pad form | 20 | ○ | Δ | ○ | Δ | ○ | x | ○ | x | |
| 5 | 2 | 2 | Form | Form | — | ○ | Δ | ○ | x | ○ | x | ○ | x | 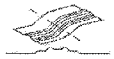 |
| | | | Form | Pad form | 20 | ○ | Δ | ○ | Δ | ○ | Δ | ○ | x | |
| 6 | 2 | — | Form | Form | — | ○ | x | ○ | x | ○ | x | ○ | x | 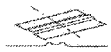 |
| | | | Form | Pad form | 20 | ○ | Δ | ○ | x | ○ | x | ○ | x | |
| 7 | 2 | 2 | Form | Form | — | ○ | ○ | ○ | ○ | ○ | ○ | ○ | ○ | 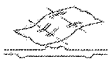 |
| | | | Form | Pad form | 20 | ○ | ○ | ○ | ○ | ○ | ○ | ○ | ○ | |

Herein, the evaluation of press formed products was visually performed and was performed in three grades of "○", "Δ", and "x". The evaluations are shown in Tables 2 and 3.

Specifically, the evaluation was performed as follows: "x" when significant wrinkles were generated, "Δ" when no significant wrinkles were generated but slight wrinkles were formed, and "○" when no wrinkles were generated.

COMPARATIVE EXAMPLES

In the forming methods of Comparative Examples, as shown in Table 2, when steel sheets with a tensile strength of 980 MPa or more were used, significant wrinkles were generated in at least either the top sheet portion 1A or the flange portion 1C.

Figure 9:
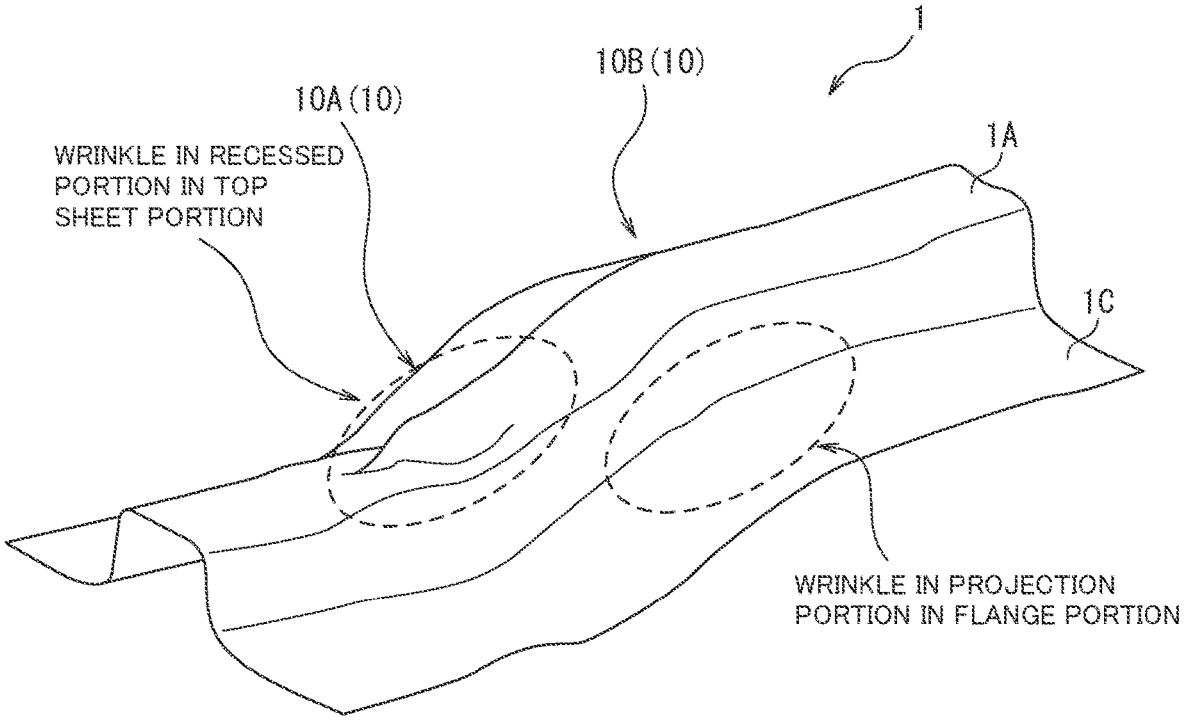
FIG. 9 is a view illustrating an example of the generation of wrinkles.

FIG. 9 illustrates an example of the generation of wrinkles in the top sheet portion 1A and the flange portion 1C in the case of the stamping using the 1180 material in Comparative Examples.

Examples of Invention

On the other hand, it was found in Examples of Invention that the generation of wrinkles was improved in the sites where the first beads 4*a* or the second beads 4*b* were given as compared with Comparative Examples as shown in Table 3.

Herein, the shape after the preliminary forming step 2 in each Example of Invention is described.

No. 1 is an example of giving the curved shape and giving the first beads 4*a* and the second beads 4*b* containing a full bead to the first bent portion 1*d* and the second bent portion 1*e*, respectively.

The height of the beads 4*a*, 4*b* is five times the sheet thickness. The same applies to the other Examples of Invention.

No. 2 is an example of giving the curved shape, giving the first beads 4*a* containing a half bead to the first bent portion 1*d*, and giving the second beads 4*b* containing a full bead to the second bent portion 1*e*.

No. 3 is an example of giving the curved shape, not forming the first beads 4*a* in the first bent portion 1*d*, and giving the second beads 4*b* containing a full bead to the second bent portion 1*e*.

No. 4 is an example of giving the curved shape, forming the first beads 4*a* containing a full bead in the first bent portion 1*d*, and not forming the second beads 4*b* in the second bent portion 1*e*.

No. 5 is an example of giving the curved shape, giving the first beads 4*a* containing a half bead to the first bent portion 1*d*, and giving the second beads 4*b* containing a half bead to the second bent portion 1*e*.

No. 6 is an example of not giving the curved shape, forming the first beads 4*a* containing a full bead in the first bent portion 1*d*, and not forming the second beads 4*b* in the second bent portion 1*e*.

No. 7 is an example of giving the curved shape, partially giving the first beads 4*a* containing a full bead only to the position of the recessed curved portion 10A in the first bent portion 1*d*, and partially giving the second beads 4*b* containing a full bead along the longitudinal direction only to the position of the projecting curved portion 10B in the second bent portion 1*e*. In No. 7, the position where the curved portion 10A is formed, which is a position for providing the first beads 4*a*, and the position where the projecting curved portion 10B, which is a position for providing the second beads 4*b*, are different from each other in the longitudinal direction.

As is understood from No. 1, when the curved shape was given and the first beads 4*a* and the second beads 4*b* each containing a full bead were given to the first bent portion 1*d* and the second bent portion 1*e*, respectively, no wrinkles were generated in the top sheet portion 1A and the flange portion 1C.

At this time, even when the first beads 4*a* and the second beads 4*b* each containing a full bead were partially given to only a region where the generation of wrinkles was estimated as in No. 7, no wrinkles were generated in the top sheet portion 1A and the flange portion 1C.

When the first beads 4*a* contained a half bead and the second beads 4*b* contained a full bead as in No. 2, no wrinkles were generated in the flange portion 1C but, in the stamping, wrinkles were generated in the top sheet portion 1A. This is because an improvement of the shape rigidity on the top sheet portion 1A side was lower than that in No. 1. However, the degree of wrinkles in the top sheet portion 1A was milder than that in Comparative Examples (Table 2), and, even in the case of the half bead, a wrinkle reduction effect was observed.

It was also found that the generation of wrinkles in the flange portion 1C was able to be suppressed when only the second beads 4*b* were provided as in No. 3.

It was also found that the generation of wrinkles in the top sheet portion 1A was able to be suppressed when only the first beads 4*a* were provided as in No. 4.

When the first beads 4*a* contained a full bead and the second beads 4*b* contained a half bead as in No. 5, no wrinkles were generated in the top sheet portion 1A but wrinkles were generated in the flange portion 1C. This is because an improvement of the shape rigidity on the flange portion 1C side was lower than that in No. 1. However, the degree of wrinkles in the flange portion 1C was milder than that in Comparative Examples (Table 2), and, even in the case of the half bead, a wrinkle reduction effect was observed.

Herein, the description is given with reference to a limited number of embodiments, but the scope of the invention is not limited thereto and modifications of each embodiment based on the disclosure above are obvious to those skilled in the art.

The entire contents of JP 2020-039600 A (filed Mar. 9, 2020), for which this application claims priority, form part of this disclosure by reference.

REFERENCE SIGNS LIST

1 pressed component shape
1A top sheet portion
1B side wall portion
1C flange portion
1D, 1E edge line portion
1*d* first bent portion
1*e* second bent portion
2 preliminary forming step (first preliminary forming step, second preliminary forming step)
2A first step
2B second step
3 component forming step (first component forming step, second component forming step)
4 metal sheet
4*a* first bead
4*b* second bead

6 first estimation region acquisition unit
7 second estimation region acquisition unit
10, 10A, 10B curved portion

The invention claimed is:

1. A method for manufacturing a pressed component including forming a metal sheet into a pressed component shape having: a cross section having a top sheet portion and a side wall portion continuous to at least one side in a width direction of the top sheet portion via a first bent portion; and having one or more curved portions in which the top sheet portion is curved to project or to be recessed in a side view along a longitudinal direction intersecting the cross section, the method comprising:

a first preliminary forming step having a step of forming, to the metal sheet, a first bead continuously or partially extending along the longitudinal direction at a position where the first bent portion is formed, wherein the first bead has a shape of projecting in a same direction as a projection direction of the first bent portion; and a first component forming step of forming the metal sheet after the first preliminary forming step into the pressed component shape.

2. The method for manufacturing the pressed component according to claim 1, wherein the pressed component shape has the cross section having a flange portion continuous to the side wall portion via a second bent portion, and the first preliminary forming step has the step of forming the first bead and a step of forming, to the metal sheet, a second bead continuously or partially extending along the longitudinal direction at a position where the second bent portion is formed.

3. The method for manufacturing the pressed component according to claim 2, wherein the first bead and the second bead each partially extend at least at positions where the curved portions are formed, and the position where the curved portion is formed, the position being a formation position of the first bead, and the position where the curved portion is formed, the position being a formation portion of the second bead, are different from each other.

4. The method for manufacturing the pressed component according to claim 1, wherein the first preliminary forming step has a step of giving curves following curves of the curved portions along the longitudinal direction to the metal sheet.

5. The method for manufacturing the pressed component according to claim 1, wherein a bead height of the first bead is twice or more a sheet thickness of the metal sheet.

6. The method for manufacturing the pressed component according to claim 1, wherein the metal sheet is a high-tensile steel sheet having a tensile strength of 590 MPa or more.

7. A method for manufacturing a pressed component including forming a metal sheet into a pressed component shape having: a cross section having a top sheet portion, a side wall portion continuous to at least one side in a width direction of the top sheet portion via a first bent portion, and a flange portion continuous to the side wall portion via a second bent portion; and having one or more curved portions in which the top sheet portion is curved to project or to be recessed in a side view along a longitudinal direction in a direction-intersecting the cross section, the method comprising:

a second preliminary forming step having a step of forming, to the metal sheet, a second bead continuously or partially extending along the longitudinal direction at a position where the second bent portion is formed, wherein the second bead has a shape of being recessed in a same direction as a recessing direction of the second bent portion; and a second component forming step of forming the metal sheet after the second preliminary forming step into the pressed component shape.

8. The method for manufacturing the pressed component according to claim 7, wherein the second preliminary forming step has:

a step of giving curves following curves of the curved portions along the longitudinal direction to the metal sheet; and a step of forming the second bead.

9. The method for manufacturing the pressed component according to claim 7, wherein a bead height of the second bead is twice or more a sheet thickness of the metal sheet.

10. The method for manufacturing the pressed component according to claim 7, wherein the metal sheet is a high-tensile steel sheet having a tensile strength of 590 MPa or more.

11. A metal sheet for press forming, the metal sheet being press formed into a pressed component shape having: a cross section having a top sheet portion and a side wall portion continuous to at least one side in a width direction of the top sheet portion via a first bent portion; and having one or more curved portions in which the top sheet portion is curved to project or to be recessed in a side view along a longitudinal direction intersecting the cross section, the metal sheet comprising:

a first bead continuously or partially extending along the longitudinal direction at a position where the first bent portion is formed, wherein the first bead has a shape of projecting in a same direction as a projection direction of the first bent portion.

12. The metal sheet for press forming according to claim 11, the metal sheet being press formed into the pressed component shape having the cross section having a flange portion continuous to the side wall portion via a second bent portion, the metal sheet comprising:

a second bead continuously or partially extending along the longitudinal direction at a position where the second bent portion is formed together with the first bead.

13. The metal sheet for press forming according to claim 11, comprising:

curves following curves of the curved portions along the longitudinal direction.

14. The metal sheet for press forming according to claim 11, wherein the metal sheet is a high-tensile steel sheet having a tensile strength of 590 MPa or more.

15. A metal sheet for press forming, the metal sheet being press formed into a pressed component shape having: a cross section having a top sheet portion, a side wall portion continuous to at least one side in a width direction of the top sheet portion via a first bent portion, and a flange portion continuous to the side wall portion via a second bent portion; and having one or more curved portions in which the top sheet portion is curved to project or to be recessed in a side view along a longitudinal direction intersecting the cross section, the metal sheet comprising:

a second bead continuously or partially extending along the longitudinal direction at a position where the second bent portion is formed wherein the second bead has a shape of being recessed in a same direction as a recessing direction of the second bent portion.

16. The metal sheet for press forming according to claim 15 comprising:

curves following curves of the curved portions along the longitudinal direction.

17. The metal sheet for press forming according to claim 15, wherein the metal sheet is a high-tensile steel sheet having a tensile strength of 590 MPa or more.

* * * * *